US009579903B2

(12) United States Patent
Sodeyama et al.

(10) Patent No.: US 9,579,903 B2
(45) Date of Patent: Feb. 28, 2017

(54) TAPE CARTRIDGE

(71) Applicant: Seiko Epson Corporation, Tokyo (JP)

(72) Inventors: Hideo Sodeyama, Matsumoto (JP); Hideki Sakano, Matsumoto (JP)

(73) Assignee: Seiko Epson Corp, Tokyo (JP)

( * ) Notice: Subject to any disclaimer, the term of this patent is extended or adjusted under 35 U.S.C. 154(b) by 0 days.

(21) Appl. No.: 15/121,698

(22) PCT Filed: Mar. 19, 2015

(86) PCT No.: PCT/JP2015/058312

§ 371 (c)(1),
(2) Date: Aug. 25, 2016

(87) PCT Pub. No.: WO2015/146792

PCT Pub. Date: Oct. 1, 2015

(65) Prior Publication Data

US 2016/0361930 A1 Dec. 15, 2016

(30) Foreign Application Priority Data

Mar. 24, 2014 (JP) ..... 2014-060910

(51) Int. Cl.
*B41J 32/00* (2006.01)
*B41J 2/325* (2006.01)

(52) U.S. Cl.
CPC ..... *B41J 2/325* (2013.01)

(58) Field of Classification Search
CPC ..... B41J 2/35; B41J 32/00; B41J 31/00; B41J 32/02; B41J 33/02; B41J 33/10; B41J 33/003; B41J 31/14; B41J 31/16; B41J 33/006; B41J 33/06; B41J 31/04; B41J 17/00; B41J 17/02; B41J 2/325; B41J 33/14
See application file for complete search history.

(56) References Cited

U.S. PATENT DOCUMENTS 5,121,329 A 6/1992 Crump
5,340,433 A 8/1994 Crump
(Continued)

FOREIGN PATENT DOCUMENTS

JP 3-158228 A 7/1991
JP 2010-149434 A 7/2010
JP 2011-527238 A 10/2011

OTHER PUBLICATIONS

International Search Report, International Application No. PCT/JP2015/058312, Jun. 9, 2015.

*Primary Examiner* — Kristal Feggins
(74) *Attorney, Agent, or Firm* — ALG Intellectual Property, LLC

(57) ABSTRACT

A tape cartridge which can be positioned near a print head is provided. A tape cartridge is loaded in a tape printing device including a print head, a head support frame causing the print head to swivel, and a protrusion provided on the head support frame, and has a print tape. The tape cartridge includes a platen roller which receives a pressing force of the print head; a cartridge case having a platen support section which supports the platen roller; and a receiving section which is provided on the side of the print head, of the platen support section, and receives the protrusion.

11 Claims, 10 Drawing Sheets

(56) References Cited

U.S. PATENT DOCUMENTS

| | | | | |
|---|---|---|---|---|
| 6,190,069 | B1 * | 2/2001 | Yamaguchi | B41J 32/00 400/120.16 |
| 8,162,553 | B2 * | 4/2012 | Vandermeulen | B41J 15/044 400/613 |
| 8,469,615 | B2 * | 6/2013 | Van Britsom | B41J 32/00 400/208 |
| 2015/0298476 | A1 | 10/2015 | Yamaguchi et al. | |

* cited by examiner

TAPE CARTRIDGE

CROSS-REFERENCE TO RELATED APPLICATIONS

This application is the U.S. National Phase under 35 U.S.C. §371 of International Application No. PCT/JP2015/058312 filed on Mar. 23, 2015, which in turn claims the benefit of Japanese Application No. 2014-060910 filed on Mar. 24, 2014, the disclosures of which are expressly incorporated by reference herein.

TECHNICAL FIELD

The present invention relates to a tape cartridge loaded and used in a cartridge loading section of a tape printing device and used for printing by the tape printing device.

BACKGROUND ART

According to the related art, as a tape cartridge of this type, a tape cartridge which is positioned in a cassette loading section by an arm-shaped platen holder which supports a platen roller of tape printing device is known (see JP-A-2010-149434).

This tape cassette includes an adhesive tape spool with a double-sided adhesive tape wound thereon, a film tape spool with a film tape (print tape) wound thereon, a ribbon spool with an ink ribbon wound thereon, a ribbon take-up spool which takes up the ink ribbon, a tape drive roller, and a cassette case which accommodates these. In the cassette case, a hook-like arm section is provided on the forward side thereof, and a feed path for the film tape and the ink ribbon that are drawn out is formed in the arm section. Also, on the lateral side (front side) of the arm section, a cassette detection section is provided and an engagement groove is provided as well.

Meanwhile, the tape printing device includes a cassette loading section in which a tape cassette is loaded, a thermal head provided in the cassette loading section, a platen roller opposite the thermal head, and a platen holder which supports the platen roller and moves the platen roller toward and away from the thermal head. The platen holder is provided with a detection switch which is to be engaged with the cassette detection section of the arm section, and an engagement piece which is to be engaged with the engagement groove of the arm section.

As the platen holder is swiveled in order to cause the platen roller to contact the thermal head, the detection switch is engaged with the cassette detection section and whether the loading of the tape cassette is incorrect or not is detected, whereas the engagement piece is engaged with the engagement groove and up-down misalignment of the tape cassette is corrected.

SUMMARY

In such a tape cassette according to the related art, since the engagement piece is provided on the platen holder and the engagement groove is provided in the cassette case, the tape cassette is positioned with respect to the platen roller on the device side to such an extent that proper detection (loading) is performed. However, the thermal head and the tape cassette (film tape and ink ribbon) are not directly positioned. Meanwhile, when the platen roller is pressed on the thermal head, its counterforce acts on the tape cassette via the engagement piece of the platen holder. Also, at the time of tape feeding, a rotational force acts around the tape drive roller of the tape cassette. Therefore, there is a risk that the tape cassette may become misaligned and consequently the thermal head and the film tape may be misaligned, impairing the print quality.

An object of the invention is to provide a tape cartridge which can be positioned near a print head.

A tape cartridge according to the invention is a tape cartridge which is loaded in a tape printing device including a print head for printing on a print tape of the tape cartridge, a head moving section holding the print head and moving the print head between a printing position where printing is performed on the print tape and a retreat position retreating from the printing position, and a protrusion provided on the head moving section, and which has the print tape. The tape cartridge includes: a platen which receives a pressing force of the print head with the print tape provided in-between, at the printing position; a cartridge case having a platen support section which supports the platen; and a receiving section which is provided on the print head side of the platen support section, receives the protrusion when the print head moves to the printing position, and has a section to be pressed which is pressed by the protrusion in a loading direction in which the tape cartridge is loaded in the tape printing device.

In this case, it is preferable that, with respect to the protrusion with which the receiving section is engaged in a moving direction of the print head as an engaging/disengaging direction, the receiving section extends in the engaging/disengaging direction.

According to this configuration, with the movement of the print head, the protrusion provided on the head moving section is engaged with the receiving section provided in the platen support section of the cartridge case. Thus, the platen support section is positioned in relation to the head moving section. That is, the platen supported by the platen support section is positioned in relation to the print head supported by the head moving section. In other words, even when the platen receives a pressing force from the print head, the platen is positioned in a predetermined loading position. Meanwhile, the platen and print tape are positioned via the cartridge case. Therefore, the since the print tape and the print head are position via the platen, the print quality can be stabilized.

Also, it is preferable that the receiving section has a section to be pressed which extends in the engaging/disengaging direction and which is positioned in a direction intersecting with the engaging/disengaging direction by the protrusion.

Also, it is preferable that the section to be pressed includes a slope ascending in an engaging direction of the engaging/disengaging direction.

Also, it is preferable that the section to be pressed of the receiving section is situated below the platen.

Incidentally, when the platen is pressed by the print head, the pressing force acts on the cartridge case supporting the platen.

According to these configurations, since the receiving section is pressed by the protrusion to the cartridge loading section via the surface to be pressed, a large friction force acts between the cartridge loading section and the cartridge case against the pressing force of the print head. Therefore, even when the pressing force of the print head acts on the cartridge case via the platen, the cartridge case is restrained from being misaligned from a predetermined loading position and the initial positioning state can be maintained. Also, since the entire cartridge case is positioned by the pressing to the cartridge loading section, not only the platen but also the print tape loaded thereon can be positioned in relation to the print head.

Also, it is preferable that the platen is made up of a platen roller.

Incidentally, when the platen roller starts rotating with the print tape and the ink ribbon provided between the platen roller and the print head section (tape feeding), a rotational force around the platen roller acts on the cartridge case.

According to this configuration, even when the rotational force around the platen roller acts on the cartridge case, the cartridge case is restrained from being misaligned from a predetermined loading position and the initial positioning state can be maintained.

In this case, it is preferable that the platen support section rotatably supports the platen roller.

In this case, it is preferable that the receiving section includes an engagement groove formed in the platen support section.

According to these configurations, the positioning accuracy of the rotating platen roller can be increased in relation to the print head.

Meanwhile, it is preferable that at least a part of the receiving section exists within a range of a diameter of the platen roller, as viewed from an axial direction of the platen roller.

According to this configuration, the protrusion on the print head side is engaged with the receiving section situated near the platen. Therefore, the positioning accuracy of the platen roller can be increased in relation to the print head. Thus, print feed is accurately carried out and high print quality can be maintained.

Also, it is preferable that the platen support section has a bearing hole which rotatably supports the platen roller, and that a distal side of the engagement groove communicates with the bearing hole.

According to this configuration, the engaging position of the protrusion with the receiving section can be brought as closely to the bearing hole as possible. Therefore, the platen roller can be accurately positioned in relation to the print head.

Moreover, it is preferable that the platen support section has a bearing hole which rotatably supports the platen roller, and that the bearing hole is cut out on the print head side thereof.

According to this configuration, the print head can be prevented from interfering with the platen support section, and the pressing of the print head on the platen roller can be stabilized. Also, the positioning accuracy of the platen roller can be increased in relation to the print head. Therefore, print feed is accurately carried out and high print quality can be maintained.

DESCRIPTION OF EXEMPLARY EMBODIMENTS

Hereinafter, referring to the accompanying drawings, a tape cartridge according to an embodiment of the invention will be described along with a tape printing device in which this tape cartridge is loaded. This tape printing device carries out printing while reeling off a print tape and an ink ribbon from the loaded tape cartridge, and cuts the printed part of the print tape, thus creating a label (tape piece).

[Outline of Tape Printing Device]

Figure 1:
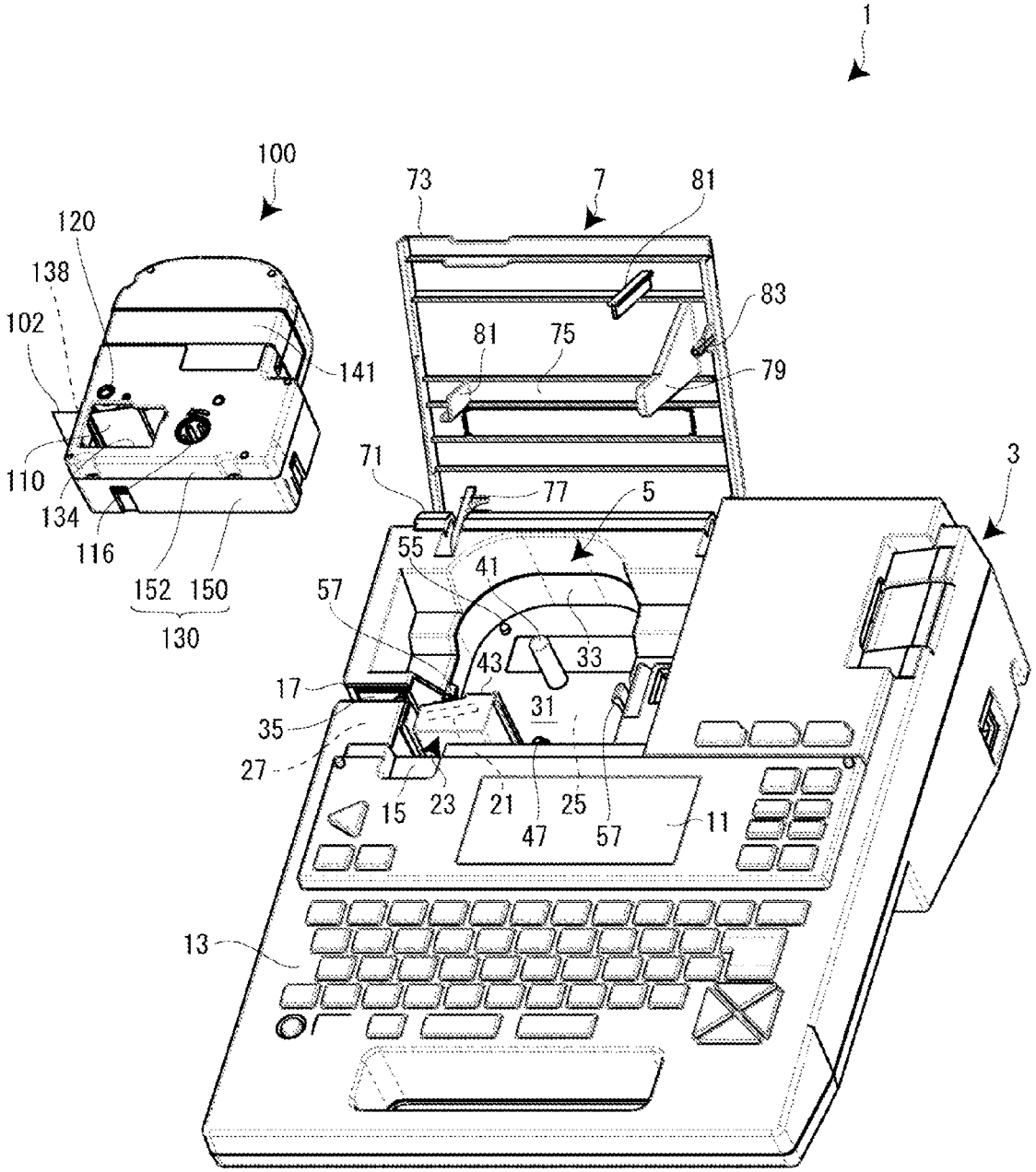
FIG. 1 is an external perspective view of an open-cover state of a tape printing device according to an embodiment.

FIG. 1 is an external perspective view of a tape printing device and a tape cartridge loaded therein. As shown in FIG. 1, a tape printing device 1 includes a device case 3 forming an outer shell, a cartridge loading section 5 in which a tape cartridge 100 is loaded in an unloadable manner, and an open/close cover 7 which opens and closes the cartridge loading section 5. On a top surface of the device case 3, the cartridge loading section 5 is provided on the rear side, a display 11 is provided in the center, and a keyboard 13 is provided on the forward side. A dent portion 15 to hook a finger is provided near the open/close cover 7. The open/close cover 7 is opened by being lifted up via this dent portion 15. Then, on a lateral side (left side) of the device case 3, a vertically long tape discharge port 17 through which a print tape 102 is discharged is provided.

Also, the tape printing device 1 includes a print mechanism section 23 having a print head 21 provided upright in the cartridge loading section 5, a tape feed mechanism section 25 provided inside the space on the back of the cartridge loading section 5, and a tape cutting mechanism section 27 provided inside near the tape discharge port 17. The user inputs print information from the keyboard 13, confirms the print information on the display 11, and subsequently executes printing by a key operation. As a print command is given, the tape feed mechanism section 25 is driven, thus causing the print tape 102 and an ink ribbon 110 to travel in parallel, and printing based on thermal transfer by the print mechanism section 23 is carried out thereon. By this print feed, the print tape 102 is discharged from the tape discharge port 17. When the printing is completed, the tape cutting mechanism section 27 is driven, thus cutting the printed part of the print tape 102.

[Outline of Tape Cartridge]

As shown in FIGS. 2A and 2B and FIGS. 5A and 5B, the tape cartridge 100 includes a tape roll 106 having the print tape 102 wound on a tape core 104. Also, the tape cartridge 100 has a ribbon roll 114 having the ink ribbon 110 wound on a reel-off core 112, and a take-up core 116 which takes up the ink ribbon 110 after use. Also, the tape cartridge 100 has a platen roller 120 (platen) against which the print head 19 abuts and which feeds the print tape 102 and the ink ribbon 110. Moreover, the tape cartridge 100 has a cartridge case 130 accommodating the tape roll 106, the ribbon roll 114, the take-up core 116 and the platen roller 120. In this way, the tape cartridge 100 in this embodiment has a so-called shell structure in which the outer shell is covered by the cartridge case 130.

Also, the tape cartridge 100 has an insertion opening 134 which is formed in the cartridge case 130 and in which the print head 21 is inserted when the tape cartridge 100 is loaded in the tape printing device 1, and a tape outlet port 138 which is formed in the cartridge case 130 and through which the print tape 102 is sent out. As will be described in detail later, the tape roll 106 is rotatably supported on a cylindrical core shaft 192 provided in a protruding manner on the inside of the cartridge case 130.

As the platen roller 120 and the take-up core 116 are driven by the above tape feed mechanism section 25, the print tape 102 is reeled off from the tape core 104, and the ink ribbon 110 is reeled off from the reel-off core 112. The print tape 102 and the ink ribbon 110, thus reeled off, travel in parallel at the part of the platen roller 120 and are used for printing by the print head 21. The reel-off end (printed part) of the print tape 102 where printing has been done is sent out toward the tape discharge port 17 from the tape outlet port 138. Meanwhile, the ink ribbon 110 travels around a circumferential wall part of the insertion opening 134 and is taken up on the take-up core 116. As the tape cartridge 100, a plurality of types with different thicknesses is prepared according to the tape widths of the print tape 102.

[Details of Tape Printing Device]

Figure 3:
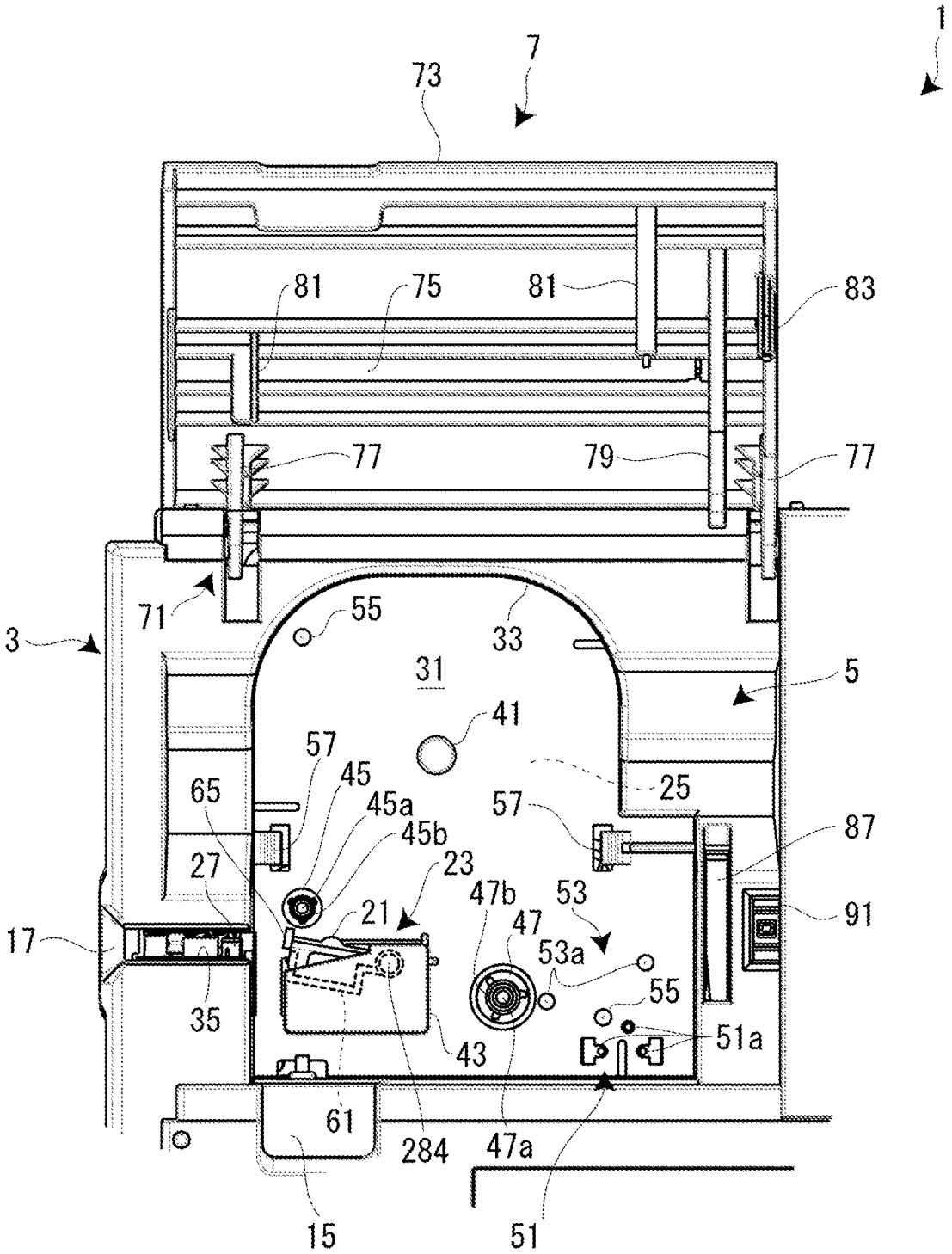
FIG. 3 is a plan view of a cartridge loading section.

As shown in FIG. 1 and FIG. 3, the cartridge loading section 5 is formed in a planar shape complimentary to the planar shape of the tape cartridge 100 and is formed as a dent having a depth corresponding to the tape cartridge 100 with the greatest thickness, of the plurality of types of loadable tape cartridges 100. In this case, a loading base 31 forming a bottom plate part of the cartridge loading section 5, and a side plate part 33 are integrally formed (molded) of a resin or the like. A slit-like tape discharge path 35 is formed between the cartridge loading section 5 and the above tape discharge port 17, and the above tape cutting mechanism section 27 is arranged inside this part.

On the loading base 31 of the cartridge loading section 5, a positioning protrusion 41 with which the core shaft 192 of the tape cartridge 100 is fitted and positioned when the tape cartridge 100 is loaded is provided upright. Also, on the loading base 31, the print head 21 covered by a head cover 43, a platen drive shaft 45 which rotationally drives the platen roller 120, and a take-up drive shaft 47 which rotationally drives the take-up core 116 are provided upright. Also, on the loading base 31, a tape detection section 51 which detects the type (attribute information) of the print tape 102, and a core release section 53 which cancels the rotation stopper of the reel-off core 112 and the take-up core 116 are provided near the take-up drive shaft 47.

Moreover, a pair of small protrusions 55 is provided at diagonal positions on the loading base 31, and in addition, a pair of hook pieces 57 which hooks a middle part of the loaded tape cartridge 100 is provided. Then, in the space on the back of the loading base 31, the above tape feed mechanism section 25 made up of a motor and a gear train (neither being illustrated) or the like for rotating the platen drive shaft 45 and the take-up drive shaft 47 is arranged inside. The tape feed mechanism section 25 performs power branching via the gear train and thus causes the platen drive shaft 45 and the take-up drive shaft 47 to rotate synchronously.

The print mechanism section 23 includes the print head 21 made up of a thermal head, a head support frame 61 which supports the print head 21 and causes the print head 21 to swivel, a head release mechanism (not illustrated) which causes the print head 21 to swivel between a printing position and a retreat position via the head support frame 61, and the head cover 43 covering the print head 21 (and the head support frame 61).

The head release mechanism is actuated, interlocked with the opening/closing of the above open/close cover 7, and causes the print head 21 to move (swivel) to the printing position with the closing operation of the open/close cover 7 and causes the print head 21 to move (swivel) to the retreat position with the opening operation. The print head 21, having moved to the printing position, abuts against the platen roller 120 of the tape cartridge 100. The print head 21, having moved to the retreat position, is spaced apart from the platen roller 120. Thus, the print tape 102 and the ink ribbon 110 are prevented from interfering with the print head 21 at the time of loading or unloading the tape cartridge 100.

A plurality of heat generating elements is provided in the print head 21, and the plurality of heat generating elements is arrayed in the same direction as the axial direction of the platen roller 120. Then, printing is carried out by feeding the print tape 102 and the ink ribbon 110 and selectively driving the plurality of heat generating elements.

As will be described in detail later, the head support frame 61 is supported on a swivel support shaft 284 in such a way as to be able to swivel, and also supports the print head via a horizontal shaft 63 provided in a vertically intermediate position therein (see FIG. 3 and FIG. 7). As the head support frame 61 swivels and moves the print head 21 to the printing position to contact the platen roller 120, the print head 21 swings properly about the horizontal shaft 63 and uniformly contacts the platen roller 120. That is, the plurality of heat generating elements of the print head 21 uniformly contacts the platen roller 120 in the arraying direction thereof. Also, as will be described in detail later, a protrusion 65 to be engaged with the cartridge case 130 is integrally formed on the head support frame 61 (see FIG. 3, FIG. 7 and FIG. 8).

The head cover 43 is formed in a substantially rectangular shape, as viewed in a plan view, and is integrally formed (molded) with the above loading base 31 (cartridge loading section 5). Also, the head cover 43 perpendicularly protrudes from the loading base 31, allows the print head 21 to swivel therein, and functions on its outside as a loading guide for the tape cartridge 100.

The tape detection section 51 is made up of a plurality of microswitches 51*a*, is selectively engaged with a section to be detected 180 of the tape cartridge 100, described later, and detects the type including tape width, tape color, material and the like of the print tape 102. Then, on the basis of the result of the detection, the driving of the print head 21 and the tape feed mechanism section 25 is controlled. The core release section 53 is made up of two cancellation pins 53*a* for the reel-off core 112 and the take-up core 116. As will be described in detail later, rotation stopper hooks 206 to be hooked on the reel-off core 112 and the take-up core 116, respectively, are provided in the cartridge case 130 (see FIG. 6). As the tape cartridge 100 is loaded, these rotation stopper hooks 206 are engaged with the cancellation pins 53*a*, cancelling the rotation stopper of the reel-off core 112 and the take-up core 116.

The platen drive shaft 45 has a fixed shaft 45*a* to be inserted through the platen roller 120, and a spline-shaped movable shaft 45*b* rotatably axially supported at a proximal part of the fixed shaft 45*a*. The rotational power of the tape feed mechanism section 25 is transmitted to this movable shaft 45*b* and further transmitted from the movable shaft 45*b* to the platen roller 120. Similarly, the take-up drive shaft 47 has a fixed shaft 47*a* and a spline-shaped movable shaft 47*b* rotatably axially supported on the fixed shaft 47*a*. In this case, too, the rotational power of the tape feed mechanism section 25 is transmitted to the movable shaft 47*b* and further transmitted from the movable shaft 47*b* to the take-up core 116.

When the tape cartridge 100 is loaded in the cartridge loading section 5, the core shaft 192 (tape core 104) is engaged with the positioning protrusion 41, and the platen roller 120 is engaged with the platen drive shaft 45. Moreover, the take-up core 116 is engaged with the take-up drive shaft 47. Then, as the open/close cover 7 is closed, the print head 21 swivels and abuts against the platen roller 120, with the print tape 102 and the ink ribbon 110 provided in-between. Thus, the tape printing device 1 enters into a print standby state.

Figure 4:
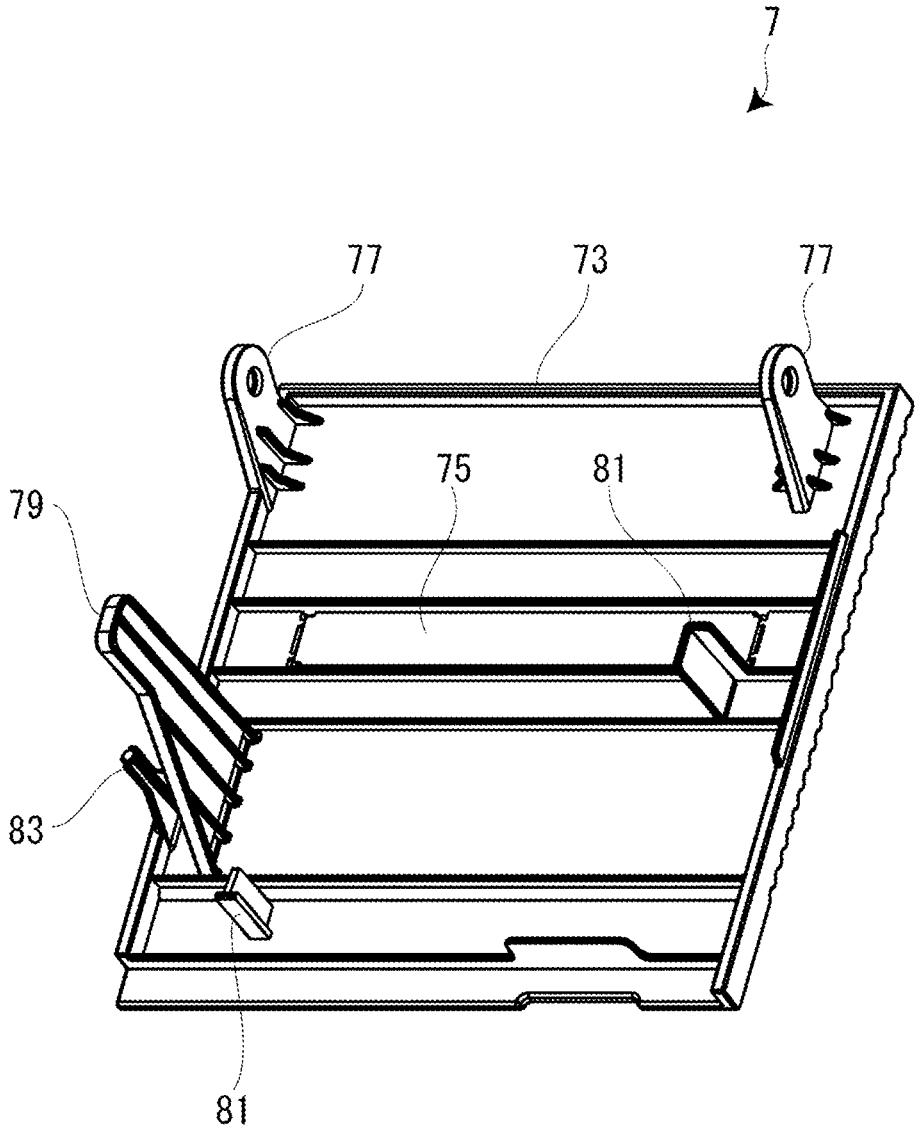
FIG. 4 is a perspective view of an open/close cover, as viewed from the back side.

As shown in FIG. 1 and FIG. 4, the open/close cover 7 is mounted on the device case 3 via a hinge portion 71 provided on the rear side, in such a way as to be able to swivel, that is, to be able to open/close. The open/close cover 7 includes an open/close cover main body 73 and a view window 75 provided at the center of the open/close cover main body 73. Also, the open/close cover 7 has a pair of shaft support pieces 77 provided in a protruding manner on the back of the open/close cover main body 73 and axially supported on the hinge portion 71 in such a way as to be able to swivel, and an actuation lever 79 which is provided in a protruding manner on the back of the open/close cover main body 73 and causes the print head 21 to swivel. Moreover, the open/close cover 7 has two push-in protrusions 81 which are provided in a protruding manner on the back of the open/close cover main body 73 and push in the tape cartridge 100, and a press protrusion 83 which is provided in a protruding manner on the back of the open/close cover main body 73 and actuates (turns ON) a built-in cover closing detection switch (not illustrated).

The view window 75 is formed to be laterally long and made of a transparent resin (transparent to visible rays) as a separate member from the open/close cover main body 73. Through this view window 75, the tape cartridge 100 loaded in the cartridge loading section 5 can be visually confirmed (the type of the print tape 102 and the amount of tape left). Also, the pair of shaft support pieces 77, the actuation lever 79, the two push-in protrusions 81 and the press protrusion 83, and the open/close cover main body 73 are integrally formed (molded) of a resin.

The actuation lever 79 protrudes largely from the back of the open/close cover main body 73. With the closing of the open/close cover 7, the actuation lever 79 is inserted in a slit opening 87 provided to the lateral side of the cartridge loading section 5. The actuation lever 79 inserted in the slit opening 87 actuates the above head release mechanism and causes the print head 21 to swivel toward the platen roller 120. Similarly, with the closing of the open/close cover 7, the press protrusion 83 is inserted in a rectangular opening 91 next to the slit opening 87 and actuates the cover closing detection switch.

One push-in protrusion 81 corresponds to a position near the platen roller 120 of the tape cartridge 100. The other push-in protrusion 81 corresponds to a position directly above the above tape detection section 51. As the open/close cover 7 is closed, the two push-in protrusions 81 push in the tape cartridge 100 so that the tape cartridge 100 sits on the loading base 31 of the cartridge loading section 5, and also prevent the tape cartridge 100 from floating up.

[Details of Tape Cartridge]

Next, the tape cartridge 100 will be described in detail, referring to FIG. 2A, FIG. 2B, FIG. 5A, FIG. 5B, and FIG. 6. In the description of the tape cartridge 100, taking FIGS. 2A and 2B as an example, the forward side in the loading direction, which is the top front side of the tape cartridge 100, is referred to as the "front side", the rear side in the loading direction, which is the opposite side, as the "back side", the lateral side on the left as the "left lateral side", the lateral side on the right as the "right lateral side", the arcuate side on the top as the "distal side", and the bottom side as the "proximal side".

The tape cartridge 100 includes the cartridge case 130, and the tape roll 106, the ribbon roll 114, the take-up core 116 and the platen roller 120 accommodated therein, as described above. Also, the tape cartridge 100 has the insertion opening 134 formed in the cartridge case 130, the tape outlet port 138 formed on the left lateral side, near the platen roller 120, and an identification seal 141 (see FIG. 1) bonded over the front side, the left lateral side and the right lateral side of the part where the tape roll 106 is accommodated. On the identification seal 141, the tape width, tape color, material and the like of the accommodated print tape 102 are shown in the form of text at the two positions of the front side and the left lateral side.

The cartridge case 130 forms the outer shell of the tape cartridge 100 (shell structure) and has an "L"-shaped appearance as viewed in a plan view, with the proximal side part on the right lateral side slightly protruding. In the front-back direction, the cartridge case 130 is formed by a lower case 150 which comes to the rear side when the tape cartridge is loaded in the cartridge loading section 5, and an upper case 152 which comes to the forward side. In the cartridge case 130 in this embodiment, the upper case 152 is formed by a molded member of a transparent resin, and the lower case 150 is formed by a molded member of an opaque resin.

The upper case 152 is integrally formed (molded) by a top wall portion 156 forming the front side of the cartridge case 130, and an upper circumferential wall portion 158 suspended on a circumferential edge part of the top wall portion 156. Meanwhile, the lower case 150 is integrally formed (molded) by a bottom wall portion 160 forming the back side of the cartridge case 130, a lower circumferential wall 162 provided upright on a circumferential edge part of the bottom wall portion 160, and an opening circumferential wall portion 164 provided upright on the bottom wall portion 160 so as to define the above insertion opening 134.

Figures 5A, 5B:
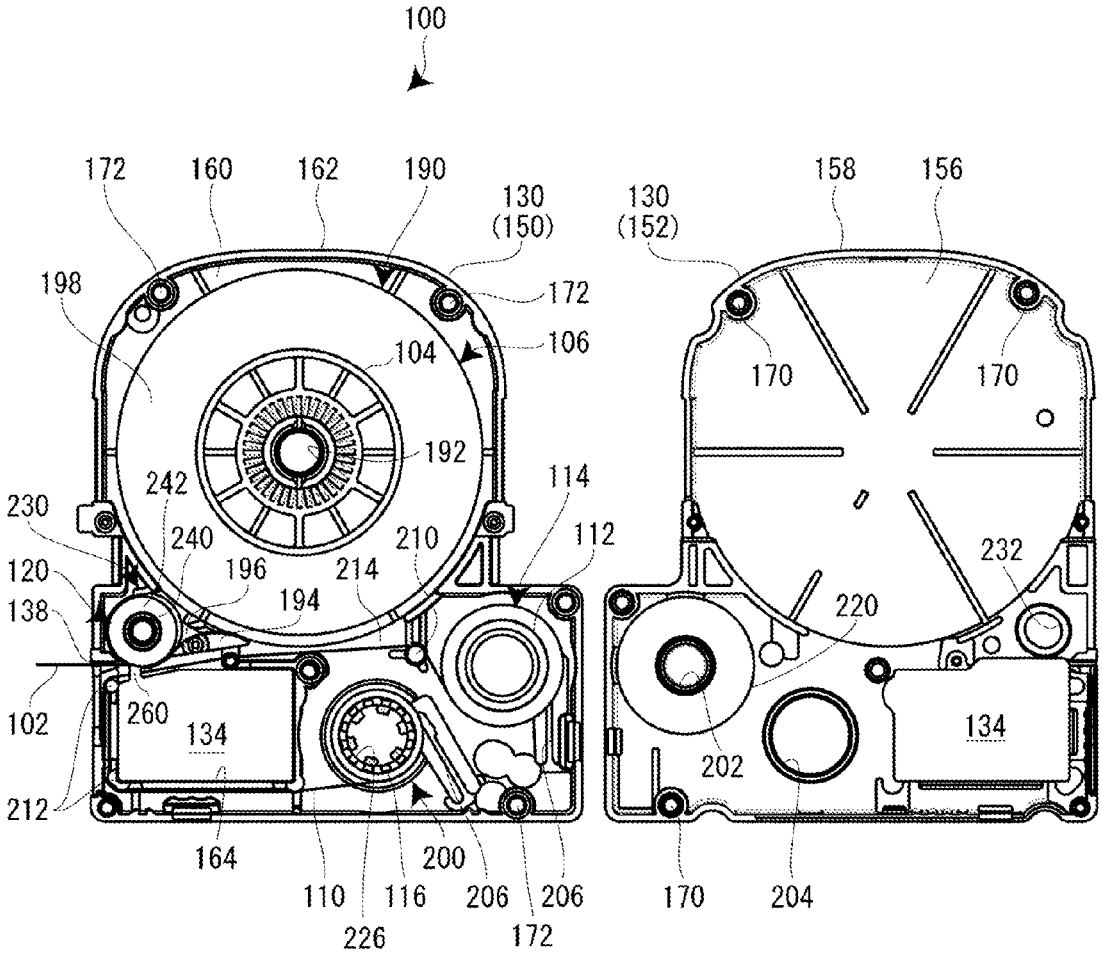
FIG. 5A is a plan view of a tape cartridge in the state where an upper case is removed.
FIG. 5B is a back view of the upper case.

A plurality of joint pins 170 is provided at a proper interval on a lower end surface of the upper circumferential wall portion 158 of the upper case 152, whereas a plurality of joint holes 172 corresponding to the plurality of joint pins 170 is provided in the lower circumferential wall 162 of the lower case 150 (see FIGS. 5A and 5B). After components such as the tape roll 106 and the ribbon roll 114 are arranged in the lower case 150, the upper case 152 is joined thereto in such away that the plurality of joint pins 170 is press-fitted in the plurality of joint holes 172, thus assembling the tape cartridge 100. Each joint hole 172 is a through-hole in consideration of easiness of molding.

Figure 2A:
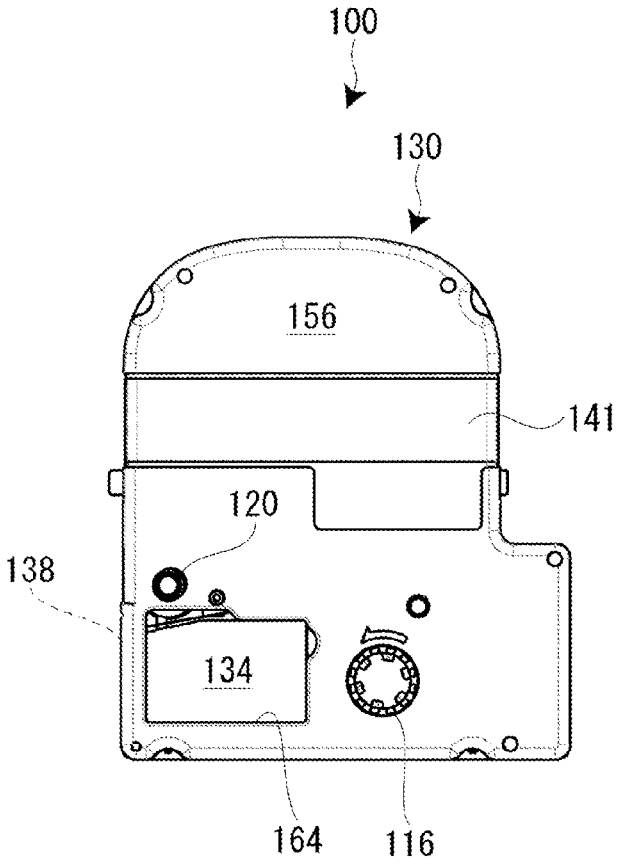
FIG. 2A is a plan view and FIG. 2B is a side view of a tape cartridge according to an embodiment.
Figure 2B:
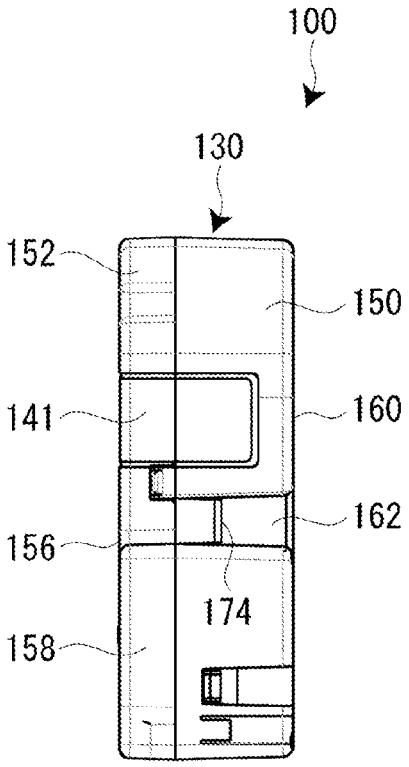
Figure 6:
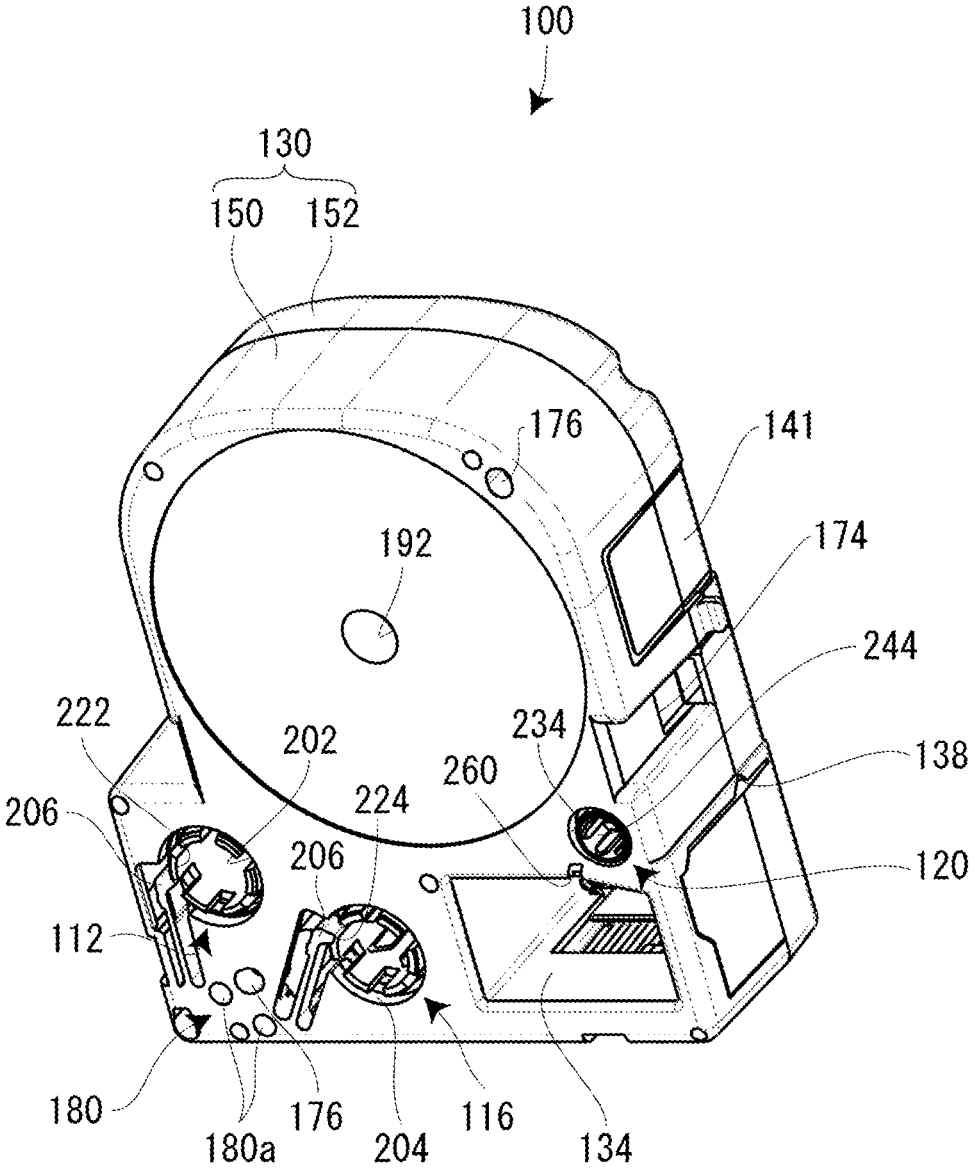
FIG. 6 is a perspective view of a tape cartridge, as viewed from the back side.

Meanwhile, a pair of hook receiving portions 174 to be hooked on the above pair of hook pieces 57 is provided on the left lateral side and the right lateral side of the lower case 150 (see FIG. 2A, FIG. 2B, and FIG. 6). As the pair of hook pieces 57 on the side of the cartridge loading section 5 is hooked on the pair of hook receiving portions 174 of the loaded tape cartridge 100, the tape cartridge 100 is prevented from floating up. Also, fitting small holes 176 in which the above pair of small protrusions 55 is fitted with a certain margin are provided on the back side of the lower case 150 (see FIG. 6). As the pair of small protrusions 55 on the side of the cartridge loading section 5 is fitted in the pair of fitting small holes 176 of the loaded tape cartridge 100, the tape cartridge 100 is easily positioned on the loading base 31.

Moreover, on the back side of the lower case 150, the section to be detected 180 corresponding to the above tape detection section 51 is provided at a position in the left corner on the proximal side (right corner as viewed from the front side) (see FIG. 6). The section to be detected 180 is formed by a section corresponding to the plurality of micro-switches 51*a* of the tape detection section 51, and a plurality of bit patterns is acquired according to the presence/absence of receiving holes 180*a* provided in this section. That is, the bit patterns correspond to the type of the above printed tape 102.

As shown in FIG. 5A, a broad tape accommodation area 190 in which the tape roll 106 is accommodated is formed in a space on the upper side (distal side) in the cartridge case 130. At the center of the tape accommodation area 190, the core shaft 192 integrally formed (molded) with the lower case 150 is provided upright. The core shaft 192 is cylindrically formed, and on its outer circumferential surface, the tape roll 106 (tape core 104) is rotatably axially supported. Also, in the tape accommodation area 190, near the platen roller 120, a tape guide 194 which guides the reeled-off print tape 102 to the platen roller 120 is provided upright integrally with the lower case 150.

That is, inside the cartridge case 130, a tape feed path 196 is formed, starting at the tape roll 106 and reaching the tape outlet port 138 via the tape guide 194 and the platen roller 120. The print tape 102 reeled off from the tape roll 106 is guided to the platen roller 120 via the tape guide 194, used for printing there, and further guided from the platen roller 120 to the tape outlet port 138.

The tape roll 106 has the print tape 102 and the tape core 104, and also has two films 198 bonded to both end surfaces of the print tape 102 in a roll shape. The two films 198 prevent the print tape 102 wound on the tape core 104 from unwinding. Also, a reverse rotation stopper mechanism is incorporated in the tape core 104, though not illustrated. When carrying the tape cartridge 100, reverse rotation of the print tape 102 is prevented by this reverse rotation stopper mechanism. Meanwhile, when the tape cartridge 100 is loaded in the cartridge loading section 5 of the tape printing device 1, the reverse rotation stopper by the reverse rotation stopper mechanism is cancelled by the above positioning protrusion 41, thus enabling the print tape 102 to be fed.

On the right side of the proximal part in the cartridge case 130, a ribbon accommodation area 200 is formed next to the insertion opening 134. To the right in the ribbon accommodation area 200, a reel-off side bearing portion 202 which rotatably supports the ribbon roll 114 (reel-off core 112), and to the left, a take-up side bearing portion 204 which rotatably supports the take-up core 116, are formed integrally with the cartridge case 130. That is, the reel-off side bearing portion 202 and the take-up side bearing portion 204 are formed each in the upper case 152 and the lower case 150.

In cut-out parts of the reel-off side bearing portion 202 and the take-up side bearing portion 204 formed in the lower case 150, rotation stopper hooks 206 having their distal parts facing the reel-off side bearing portion 202 and the take-up side bearing portion 204 are integrally formed, respectively. Then, one rotation stopper hook 206 is engaged with the reel-off core 112 and the other rotation stopper hook 206 is engaged with the take-up core 116, each in a rotation stopping state.

In the ribbon accommodation area 200, near the reel-off side bearing portion 202, a first ribbon guide 210 which guides the reeled-off ink ribbon 110 to the platen roller 120 is provided upright integrally with the lower case 150. Also, on the outer circumferential side of the above opening circumferential wall portion 164, a plurality of second ribbon guides 212 which guides the circular movement of the ink ribbon 110 is integrally formed.

That is, inside the cartridge case 130, a ribbon feed path 214 is formed, starting at the ribbon roll 114 and reaching at the take-up core 116 via the first ribbon guide 210, the platen roller 120 and the plurality of second ribbon guides 212. The ink ribbon 110 reeled off from the ribbon roll 114 is guided to the platen roller 120 via the first ribbon guide 210, is used for printing there, then further travels around the opening circumferential wall portion 164 (the plurality of second ribbon guides 212) from the platen roller 120, and is taken up on the take-up core 116.

The ribbon roll 114 has the ink ribbon 110 and the reel-off core 112, and also has a ring-shaped leaf spring 220 which applies a braking load to the reel-off core 112 (see FIG. 5B). The leaf spring 220 is formed in a wave shape in the circumferential direction and is provided between the top wall portion 156 of the upper case 152 and the reel-off core 112 in the axial direction. That is, a rotation braking load is applied to the reel-off core 112 by the spring force of this leaf spring 220. Thus, a back tension is applied to the ink ribbon 110 being reeled off by the take-up core 116, preventing the ink ribbon 110 from loosening.

The reel-off core 112 is cylindrically formed, and at its end on the side of the lower case 150, a plurality of cut-outs 222 is formed in the circumferential direction (see FIG. 6). Then, the above rotation stopper hooks 206 are to be engaged with and disengaged from the plurality of cut-outs 222. While the reel-off side bearing portion 202 on the side of the lower case 150 supporting the reel-off core 112 is formed as a circular opening, the reel-off side bearing portion 202 on the side of the upper case 152 is formed as a cylindrical protruding part. Then, the above leaf spring 220 is mounted on this protruding part.

Similarly, the take-up core 116 is cylindrically formed, and at its end on the side of the lower case 150, a plurality of cut-outs 224 is formed in the circumferential direction. Then, the above rotation stopper hooks 206 are engaged with and disengaged with the plurality of cut-outs 224. Also, a spline groove 226 is formed on the inner circumferential surface of the take-up core 116 and spline-engaged with the above take-up drive shaft 47. Thus, the rotational force of the take-up drive shaft 47 is transmitted to the take-up core 116, and the ink ribbon 110 is taken up.

On the left side of the proximal part in the cartridge case 130, a platen accommodation area 230 is formed next to the insertion opening 134. In the center of the platen accommodation area 230, a lower bearing portion 234 (see FIG. 6) in the form of an elliptic opening formed in the lower case 150, and an upper bearing portion 232 (see FIG. 5B) in the form of an elliptic opening formed in the upper case 152 are provided. Then, on the upper bearing portion 232 and the lower bearing portion 234, the platen roller 120 is supported in a rotatable and slightly laterally movable manner. That is, the platen roller 120 supported on the elliptic upper bearing portion 232 and lower bearing portion 234 is configured to be movable (finely movable) between a home position where the platen roller 120 is engaged with the platen drive shaft 45 and a nipping position where the platen roller 120 abuts against the tape guide 194 with the print tape 102 nipped between them.

Incidentally, this tape cartridge 100 is carried in the state where the reel-off end of the print tape 102 is slightly protruding outward from the tape outlet port 138 (see FIG. 1). In this case, if a push-in force or pull-in force acts on the reel-off end of the print tape 102 by mistake, the platen roller 120, drawn by this, moves to the above nipping position. Thus, the reel-off end of the print tape 102 is prevented from being pulled into the cartridge case 130 from the tape outlet port 138.

The platen roller 120 has a cylindrical roller base 240 and a rubber roller 242 mounted on the outer circumferential surface of the roller base 240. The rubber roller 242 has a length corresponding to the print head 21 in the axial direction. The print head 21, having moved to the printing position, abuts against this rubber roller 242 with the print tape 102 and the ink ribbon 110 nipped between them. Also, a spline groove 244 is formed on the inner circumferential surface of the roller base 240 and spline-engaged with the above platen drive shaft 45. Thus, the rotational force of the platen drive shaft 45 is transmitted to the platen roller 120, and the print tape 102 (and the ink ribbon 110) is fed for printing.

As will be described in detail later, the bottom wall portion 160 of the lower case 150 forming the platen accommodation area 230 forms a platen support section 250 which supports the platen roller 120. A bearing boss portion 252 is formed integrally with the platen support section 250 in such a way as to fringe the above lower bearing portion 234 (see FIG. 8). That is, the platen roller 120 has its lower part supported in a radial direction by the lower bearing portion 234 and in a thrust direction by the bearing boss portion 252.

Also, an access opening 256 (edge of a head insertion port) where the print head 21 faces is formed in the sidewall on the side of the print head 21, of the platen accommodation area 230, that is, a part of the opening circumferential wall portion 164 facing the platen accommodation area 230. Then, on the side of the print head 21, of the platen support section 250, a receiving section 260 formed in such a way as to cut in from this access opening 256 is provided (see FIG. 8). As will be described in detail later, the above protrusion 65 provided on the head support frame 61 is engaged with this receiving section 260.

Receiving Section and Protrusion

First Embodiment

Next, referring to FIG. 7 and FIG. 8, the structure of the receiving section 260 the tape cartridge 100 according to the first embodiment will be described in detail along with the structure of the protrusion 65 of the print mechanism section 23. As described above, the protrusion 65 is formed on the head support frame 61 (head moving section) of the print mechanism section 23, and the receiving section 260 is formed in the platen support section 250 of the tape cartridge 100 (see the enlarged view in FIG. 8). Then, by forward and backward swiveling of the head support frame 61 with the movement of the print head 21, the protrusion 65 is engaged with and disengaged from the receiving section 260.

Figure 7:
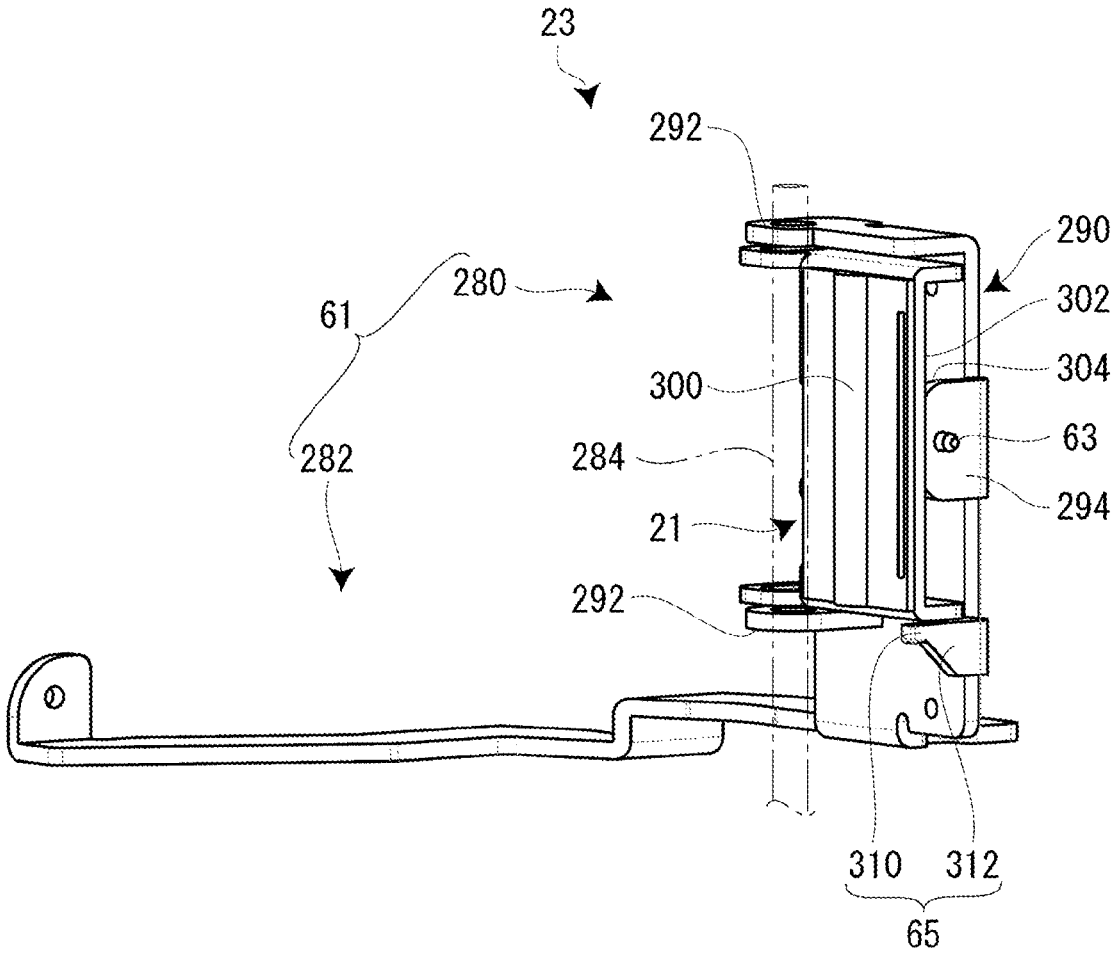
FIG. 7 is a perspective view of a print mechanism section corresponding to a tape cartridge according to a first embodiment.

As shown in FIG. 7, the print mechanism section 23 includes the print head 21 and the head support frame 61 made of a sheet metal which supports the print head 21. The head support frame 61 includes a main frame section 280 and an interlocking link section 282 extending from the main frame section 280 and is supported in such a way as to be able to swivel on a swivel support shaft 284 extending from a frame, not illustrated, in an intermediate part. Then, the above head release mechanism (not illustrated) is connected to the interlocking link section 282 on its proximal side.

The main frame section 280 includes a frame main body section 290 situated on the back side of the print head 21, a pair of upper and lower shaft support pieces 292 which extends from the frame main body section 290 toward the interlocking link section 282 and is axially supported by the swivel support shaft 284, a pair of left and right head support pieces 294 which is formed in the form of bending toward the print head 21 on both sides of the frame main body section 290, and the protrusion 65 provided on a lower part of the frame main body section 290. Then, the print head 21 is supported in the main frame section 280 by a horizontal shaft 63 arranged in such a way as to be laid between the pair of head support pieces 294.

The print head 21 has a head main body 300 with a plurality of heat generating elements arrayed on the surface, and a head base 302 holding the head main body 300. The head base 302 has a pair of left and right base shaft support pieces 304 formed in the form of bending to the back side on both sides of the head base, and is supported on the horizontal shaft 63 in the state where this pair of base shaft support pieces 304 is superimposed on the inner side of the above head support pieces 294. That is, the print head 21 is configured to move (in practice, swivel) about the swivel support shaft 284 and to be able to swing in a direction straight thereto. Thus, the head main body 300 uniformly contacts the platen roller 120.

Figure 8:
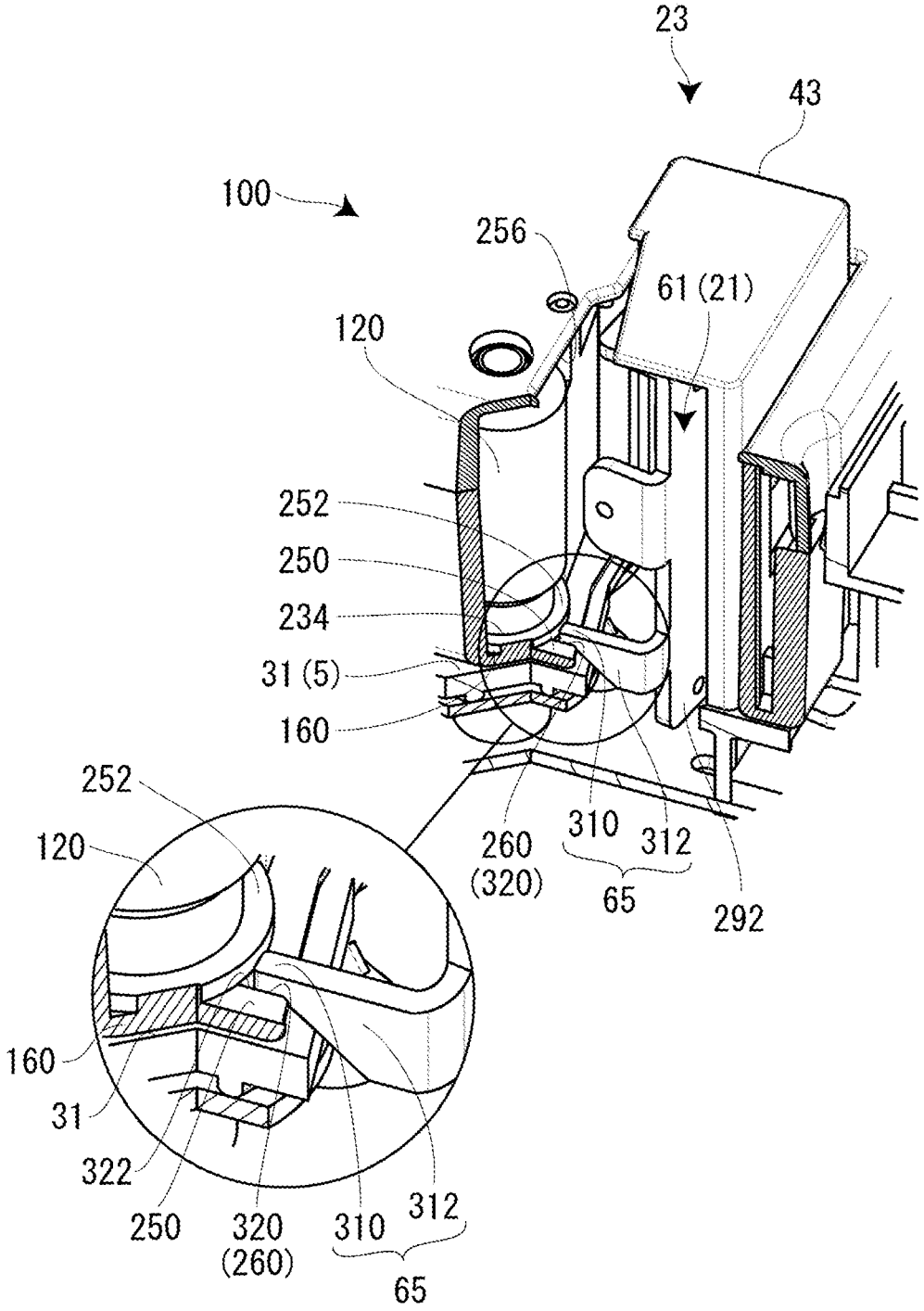
FIG. 8 is an enlarged cross-sectional view showing the relation between a receiving section (cut-in section) of a tape cartridge and a protrusion of a head support frame according to the first embodiment.

As shown in FIG. 7 and FIG. 8, the protrusion 65 is formed in the form of bending toward the print head 21 in the lower part of the frame main body section 290 and protrudes below the print head 21. That is, the protrusion 65 is formed integrally with the frame main body section 290 of the head support frame 61. In this case, the protrusion 65 protrudes in the moving direction of the print head 21, more strictly, in a tangential direction to a circle about the swivel support shaft 284, from the frame main body section 290.

Also, the protrusion 65 is formed integrally by a protruding engagement portion 310 engaged with the above receiving section 260, and a protrusion reinforcing section 312 extending from the protruding engagement portion 310 to the frame main body section 290. The protruding engagement portion 310 has its bottom surface formed at a position coinciding with the top surface of the loading base 31 and with a slightly greater thickness than the thickness of the platen support section 250 (bottom wall portion 160). Moreover, the protruding engagement portion 310 is formed with a length such that its distal end comes near a point just short of the bearing boss portion 252 of the platen support section 250 in the state where the print head 21 is in contact with the platen roller 120.

Meanwhile, as shown in FIG. 8, the receiving section 260 formed in the platen support section 250 arranged below the platen roller 120 is formed by a cut-in section 320 cut in from the access opening 256 in order to receive the protrusion 65 on the side of the print head 21, of the platen support section 250. In this case, it is preferable that at least a part of the cut-in section 320 exists within the range of the diameter of the platen roller 120, as viewed from the axial direction of the platen roller 120, near where the platen roller 120 is axially supported. The cut-in section 320 in the embodiment is arranged on the inner side of two tangents in the engaging/disengaging direction of the print head 21 in the platen roller 120, and is provided as closely to the platen roller 120 as possible.

Then, the cut-in section 320 is formed in a complementary shape to the protruding engagement portion 310 of the protrusion 65 and extends to the vicinity of a point just short of the bearing boss portion 252 in the moving direction of the print head 21. Specifically, the cut-in section 320 has a pair of sections to be pressed 322 which has a surface to be pressed 334 functioning as the sections to be pressed 322 pressed in the loading direction by the protrusion 65 when the print head 21 moves to the printing position and which positions the tape cartridge 100 in the loading direction and extends in the engaging/disengaging direction on both lateral sides thereof. The pair of sections to be pressed 322 faces each other in parallel and is positioned by the protrusion 65 engaged therewith. That is, the cut-in section 320 is positioned in a direction orthogonal to the engaging/disengaging direction by the protrusion 65 via the pair of sections to be pressed 322.

As the print head 21 moves to the printing position, the protrusion 65 of the head support frame 61 is engaged with the cut-in section 320 of the platen support section 250. In this state, both lateral sides of the protrusion 65 (protruding engagement portion 310) contact the pair of sections to be pressed 322 of the cut-in section 320. That is, the cut-in section 320 of the platen support section 250 is positioned in a direction orthogonal to the moving direction (engaging/disengaging direction) of the print head 21 by the protrusion 65 of the head support frame 61. Thus, by the protrusion 65, the tape cartridge 100 is positioned in the loading direction of the tape cartridge 100 and also positioned in a direction orthogonal to the moving direction of the print head 21.

The platen roller 120, which feeds the print tape 102 and the ink ribbon 110, has a rotational power inputted from the platen drive shaft 45. In this case, the tape cartridge 100 receives a part of the rotational power via the friction force at the bearing portions (upper bearing portion 232 and lower bearing portion 234). As in the first embodiment, since the cut-in section 320 of the platen support section 250 is positioned in the loading direction of the tape cartridge 100 and in the direction intersecting with the moving direction of the print head 21 by the protrusion 65 of the head support frame 61, the tape cartridge 100 maintains the loading state against the rotational counterforce. That is, the tape cartridge 100 is positioned both in the loading direction and in the horizontal direction near the platen roller 120.

Meanwhile, in the tape cartridge 100, the platen roller 120, the print tape 102 and the ink ribbon 110 are positioned in relation to each other by the cartridge case 130 thereof. Therefore, with the engagement between the protrusion 65 and the cut-in section 320, the print head 21 and the platen roller 120, in other words, the print head 21 and the tape cartridge 100, are positioned in relation to each other via the head support frame 61 (protrusion 65). Thus, the positioning state of the tape cartridge 100 in relation to the print head 21 is properly maintained and high print quality can be maintained.

Receiving Section and Protrusion

Second Embodiment

Figure 9A:
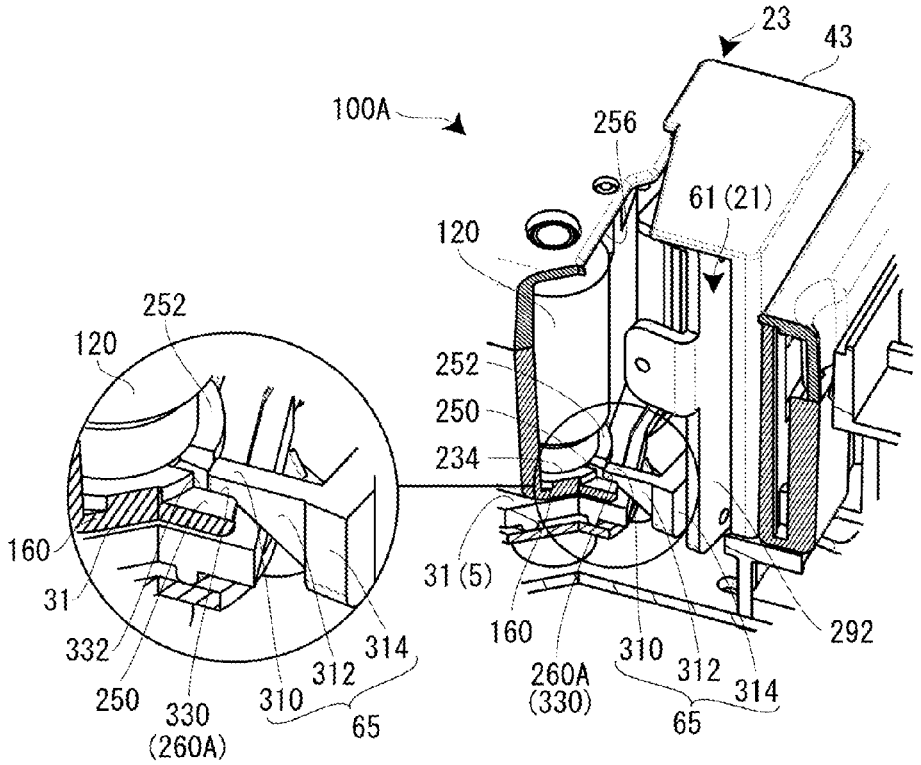
FIG. 9A is an enlarged perspective view and FIG. 9B is an enlarged cross-sectional view showing the relation between a receiving section (shallow groove section) of a tape cartridge and a protrusion of a head support frame according to a second embodiment.
Figure 9B:
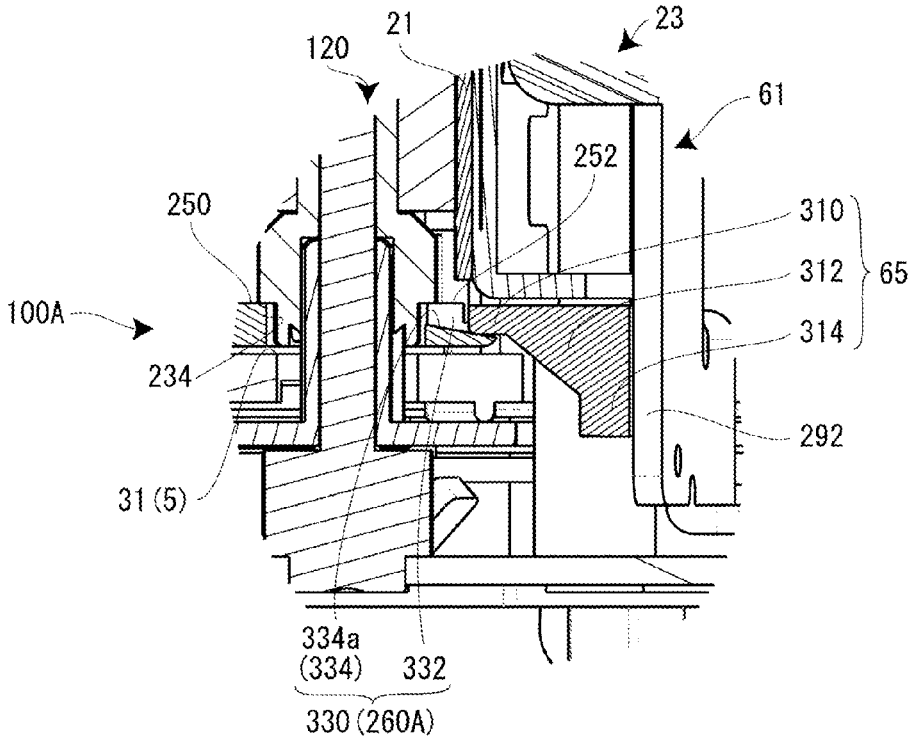

Next, referring to FIGS. 9A and 9B, the structure of a receiving section 260A of a tape cartridge 100A according to the second embodiment will be described in detail along with the structure of the protrusion 65 of the print mechanism section 23. Also, in the second embodiment, different parts from the first embodiment will be mainly described.

The protrusion 65 in the second embodiment has a form similar to the protrusion 65 in the first embodiment. However, the protrusion 65 is attached to the head support frame 61 by screwing or the like, and protrudes in the moving direction (engaging/disengaging direction) of the print head 21 from the frame main body section 290 thereof. The protrusion 65 in this case is formed of a resin or the like so as to achieve a proper spring property, and is attached to the head support frame 61 (frame main body section 290). That is, the protrusion 65 is formed integrally by a protruding engagement portion 310 engaged with the above receiving section 260A, a protrusion reinforcing section 312 extending from the protruding engagement portion 310, and a frame attachment section 314 continuing from the protrusion reinforcing section 312.

Meanwhile, the receiving section 260A is formed by a shallow groove section 330 (engagement groove) in a complementary shape to the protruding engagement portion 310. The shallow groove section 330 extends beyond the bearing boss portion 252 from the access opening 256 and in such a way that its distal end is inserted in the lower bearing portion 234 (bearing hole).

Similar to the cut-in section 320 in the first embodiment, the shallow groove section 330 in the second embodiment has a pair of sections to be pressed 332 on both lateral sides thereof. Each section to be pressed 332 is formed relatively broadly (thickly) at a part corresponding to the bearing boss portion 252, and the distal part of the protruding engagement portion 310 is engaged with this part. Also, the shallow groove section 330 has a surface to be pressed 334 pressed in the loading direction by the protrusion 65, in its part equivalent to the groove bottom. The surface to be pressed 334 includes, on the distal side, a slope 334*a* ascending in the engaging direction of the protrusion 65 (protruding engagement portion 310). As the protruding engagement portion 310 is engaged with (rides on) this slope 334*a*, the surface to be pressed 334 is pressed to the loading base 31.

That is, as the print head 21 moves to the printing position and the protrusion 65 is engaged with the shallow groove section 330, the platen support section 250 of the tape cartridge 100A is positioned in a direction orthogonal to the engaging/disengaging direction via the shallow groove section 330, and also pressed and positioned in the loading direction, with the loading base 31 serving as a support. Thus, the positioning state of the tape cartridge 100A in relation to the print head 21 is properly maintained and high print quality can be maintained.

Receiving Section and Protrusion

Third Embodiment

Figure 10A:
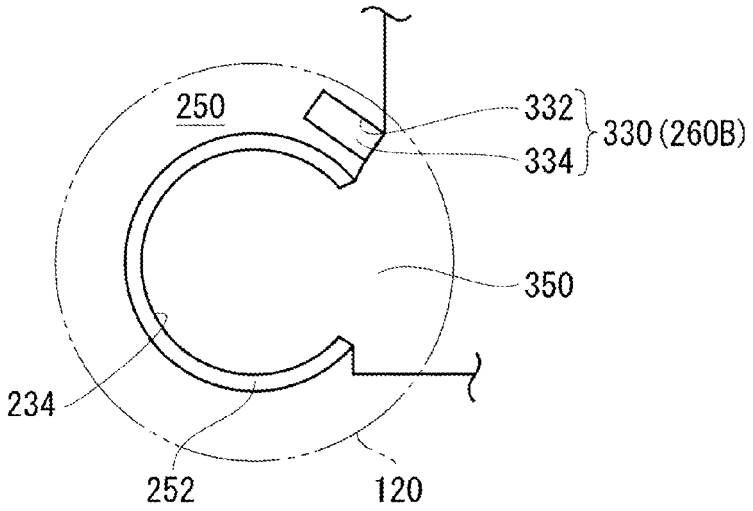
FIG. 10A is a plan view of the vicinity of a receiving section (shallow groove section) of a tape cartridge according to a third embodiment.
Figure 10B:
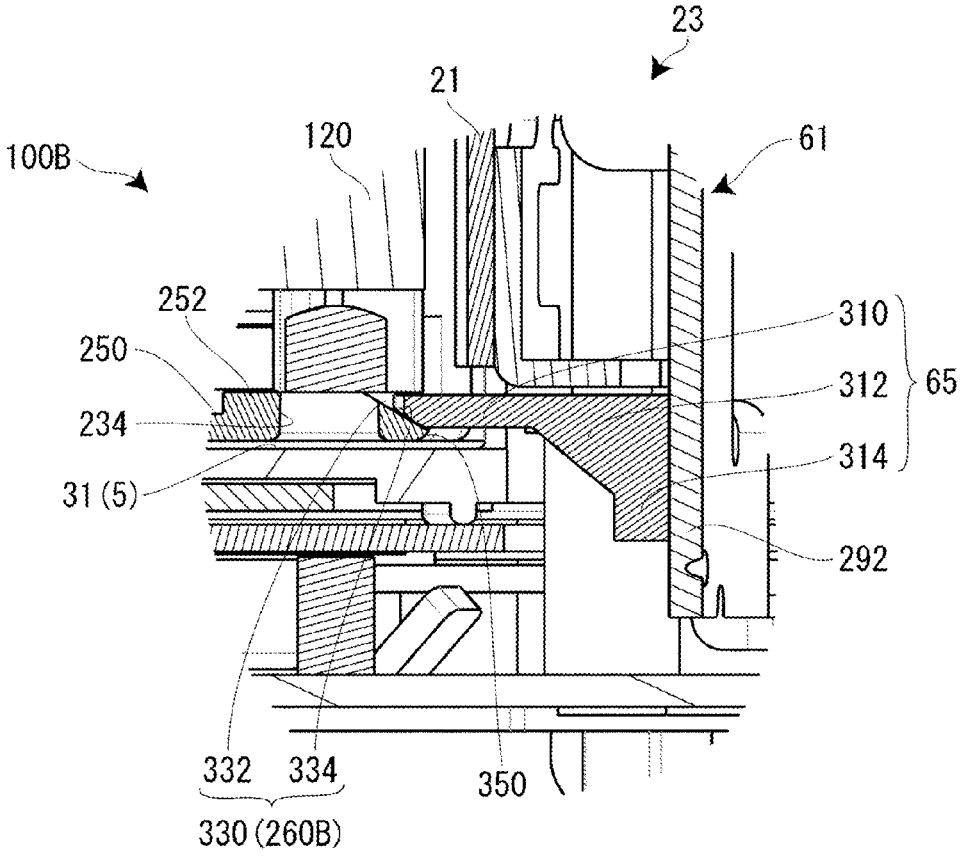
FIG. 10B is an enlarged cross-sectional view showing the relation between this receiving section (shallow groove section) and a protrusion of a head support frame.

Next, referring to FIGS. 10A and 10B, the structure of a receiving section 260B of a tape cartridge 100B according to the third embodiment will be described in detail along with the structure of the protrusion 65 of the print mechanism section 23. Also, in the third embodiment, different parts from the second embodiment will be mainly described.

In this embodiment, the part on the side of the print head 21, of the platen support section 250 including the bearing boss portion 252, is cut out in a curved shape so that the lower end part of the print head 21 will not interfere with the platen support section 250 (access opening 256) before the swiveled print head 21 contacts the platen roller 120. That is, a communicating part 350 where the lower bearing portion 234 communicates to the outside is formed on the side of the print head 21, of the platen support section 250 (see FIG. 10A).

Therefore, in the tape cartridge 100B in the third embodiment, the shallow groove section 330, which is the receiving section 260B thereof, is arranged with a shift toward the swivel support shaft 284, on a line connecting the center of the platen roller 120 to the print head 21. Also, accordingly, the protrusion 65, too, is attached to the head support frame 61 (frame main body section 290), at a position close to the swivel support shaft 284.

In this embodiment, too, as the print head 21 moves to the printing position and the protrusion 65 is engaged with the shallow groove section 330, the platen support section 250 of the tape cartridge 100B is positioned in a direction orthogonal to the engaging/disengaging direction via the shallow groove section 330 and also positioned in the loading direction with the loading base 31 serving as a support. Thus, the positioning state of the tape cartridge 100B in relation to the print head 21 is properly maintained and high print quality can be maintained.

Needless to say, the invention can also be applied to the case where a fixed platen is provided, instead of the platen roller 120, in these tape cartridges 100, 100A, 100B.

The invention claimed is:

1. A tape cartridge which is loaded in a tape printing device including a print head for printing on a print tape of the tape cartridge, a head moving section holding the print head and moving the print head between a printing position where printing is performed on the print tape and a retreat position retreating from the printing position, and a protrusion provided on the head moving section, and which has the print tape, the tape cartridge comprising:

a platen which receives a pressing force of the print head with the print tape provided in-between, at the printing position;

a cartridge case having a platen support section which supports the platen; and a receiving section which is provided on the print head side of the platen support section, receives the protrusion when the print head moves to the printing position, and has a section to be pressed which is pressed by the protrusion in a loading direction in which the tape cartridge is loaded in the tape printing device.

2. The tape cartridge according to claim 1, wherein, with respect to the protrusion with which the receiving section is engaged in a moving direction of the print head as an engaging/disengaging direction, the receiving section extends in the engaging/disengaging direction.

3. The tape cartridge according to claim 1, wherein the receiving section has a section to be pressed which extends in the engaging/disengaging direction and which is positioned in a direction intersecting with the engaging/disengaging direction by the protrusion.

4. The tape cartridge according to claim 3, wherein the section to be pressed includes a slope ascending in an engaging direction of the engaging/disengaging direction.

5. The tape cartridge according to claim 1, wherein the section to be pressed of the receiving section is situated below the platen.

6. The tape cartridge according to claim 1, wherein the platen is made up of a platen roller.

7. The tape cartridge according to claim 6, wherein the platen support section rotatably supports the platen roller.

8. The tape cartridge according to claim 7, wherein the receiving section includes an engagement groove formed in the platen support section.

9. The tape cartridge according to claim 8, wherein the platen support section has a bearing hole which rotatably supports the platen roller, and a distal side of the engagement groove communicates with the bearing hole.

10. The tape cartridge according to claim 6, wherein at least a part of the receiving section exists within a range of a diameter of the platen roller, as viewed from an axial direction of the platen roller.

11. The tape cartridge according to claim 7, wherein the platen support section has a bearing hole which rotatably supports the platen roller, and the bearing hole is cut out on the print head side thereof.

* * * * *